US008104312B2

(12) United States Patent
Hur

(10) Patent No.: US 8,104,312 B2
(45) Date of Patent: Jan. 31, 2012

(54) PANEL ASSEMBLY OF A WASHING MACHINE

(75) Inventor: Chi Wan Hur, Changwon-si (KR)

(73) Assignee: LG Electronics Inc., Seoul (KR)

( * ) Notice: Subject to any disclaimer, the term of this patent is extended or adjusted under 35 U.S.C. 154(b) by 955 days.

(21) Appl. No.: 11/507,521

(22) Filed: Aug. 22, 2006

(65) Prior Publication Data

US 2007/0180868 A1 Aug. 9, 2007

(30) Foreign Application Priority Data

Aug. 22, 2005 (KR) ..... 10-2005-0076785

(51) Int. Cl.
*D06F 21/00* (2006.01)

(52) U.S. Cl. ..... 68/142

(58) Field of Classification Search ..... 68/140, 68/142, 196; 312/107, 111, 228, 228.1
See application file for complete search history.

(56) References Cited

U.S. PATENT DOCUMENTS 2,053,482 A * 9/1936 Kellogg ..... 52/275
4,307,588 A * 12/1981 Smith et al. ..... 68/23.7
4,826,263 A * 5/1989 Speraw ..... 312/111

FOREIGN PATENT DOCUMENTS

EP 1 386 997 2/2004
GB 2 071 706 9/1981

* cited by examiner

*Primary Examiner* — Michael Barr
*Assistant Examiner* — David Cormier
(74) *Attorney, Agent, or Firm* — McKenna Long & Aldridge LLP

(57) ABSTRACT

A washing machine is provided. The washing machine includes a front panel defining a front portion of the washing machine, a decoration panel covering a front-outer circumference of the front panel, a coupling projection formed on at least one of the front and decoration panels, and a slot-shaped hole formed on at least one of the front and decoration panels so that the coupling projection can be sliding-coupled thereto.

16 Claims, 6 Drawing Sheets

【Figure 1】(Related art)
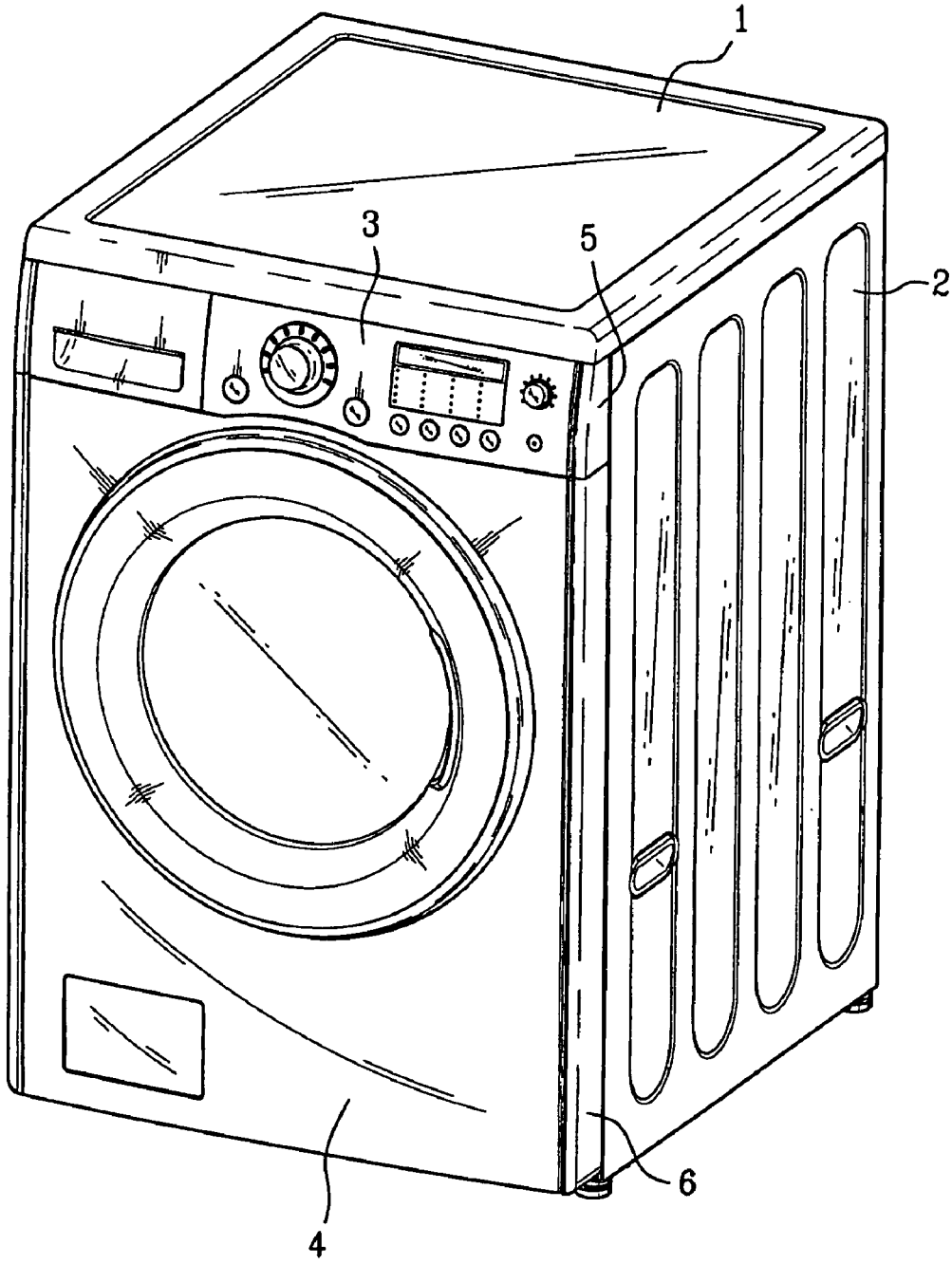

【Figure 2】(Related art)
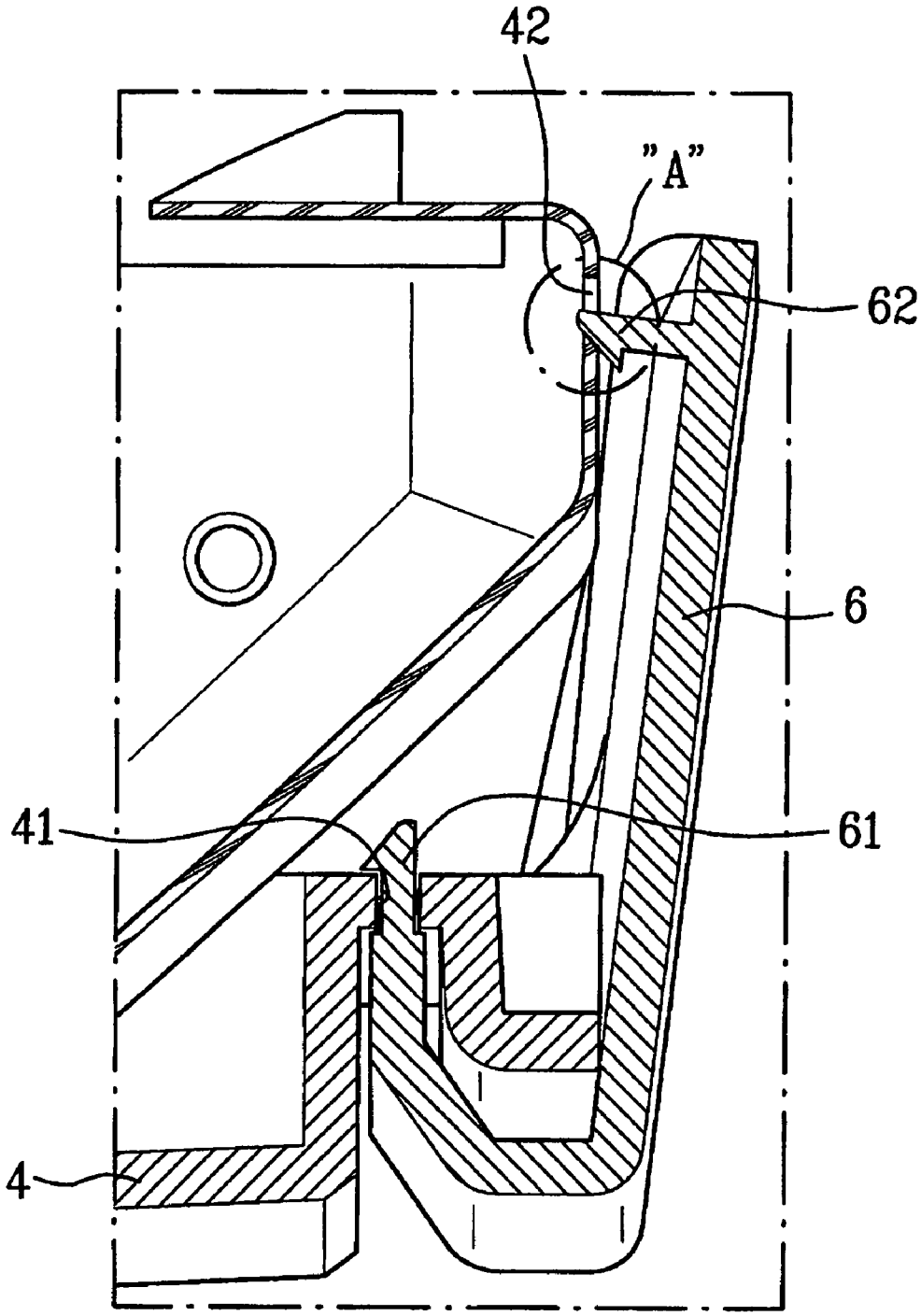

【Figure 3】(Related art)
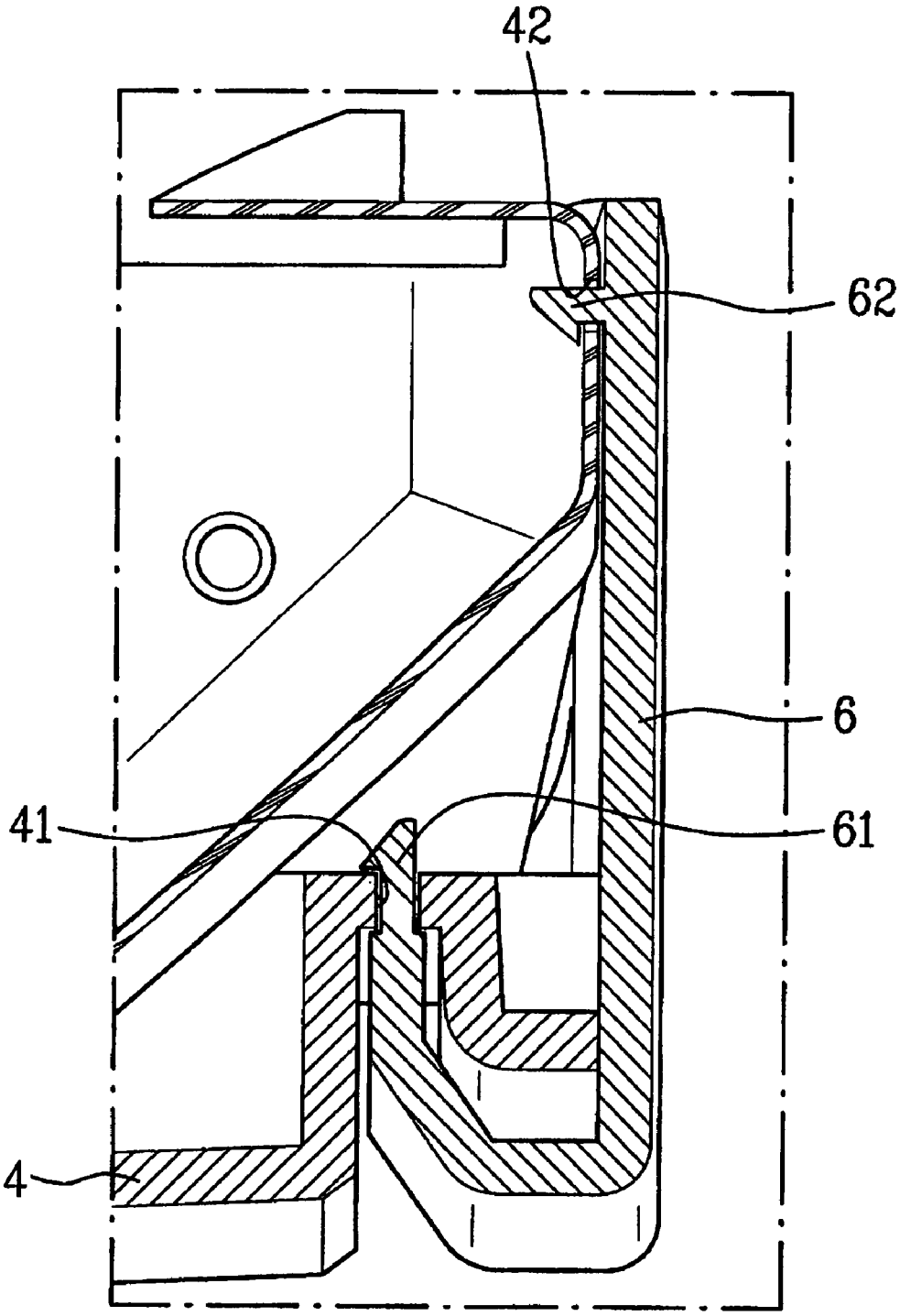

【 Figure 4】
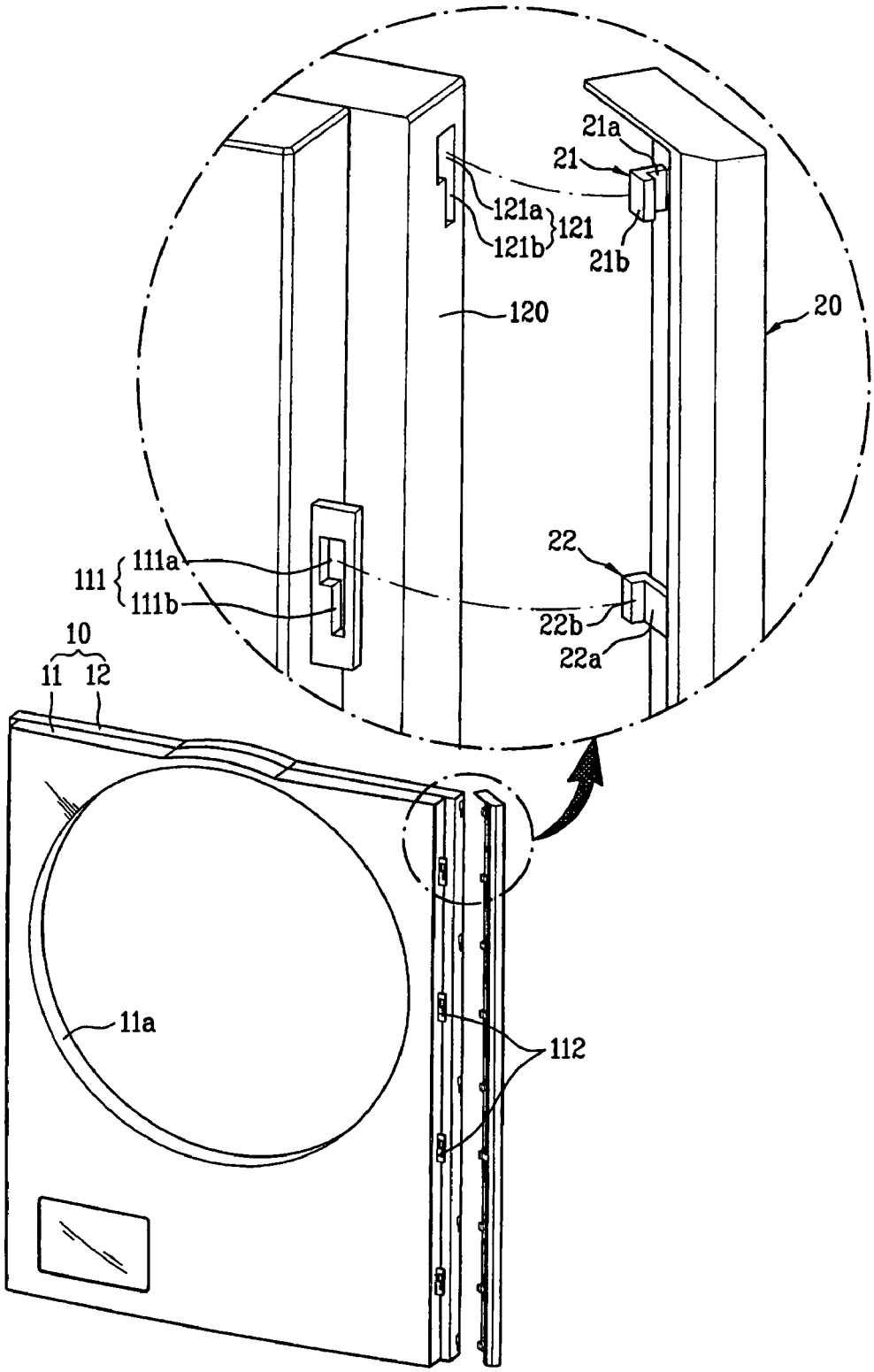

【Figure 5】
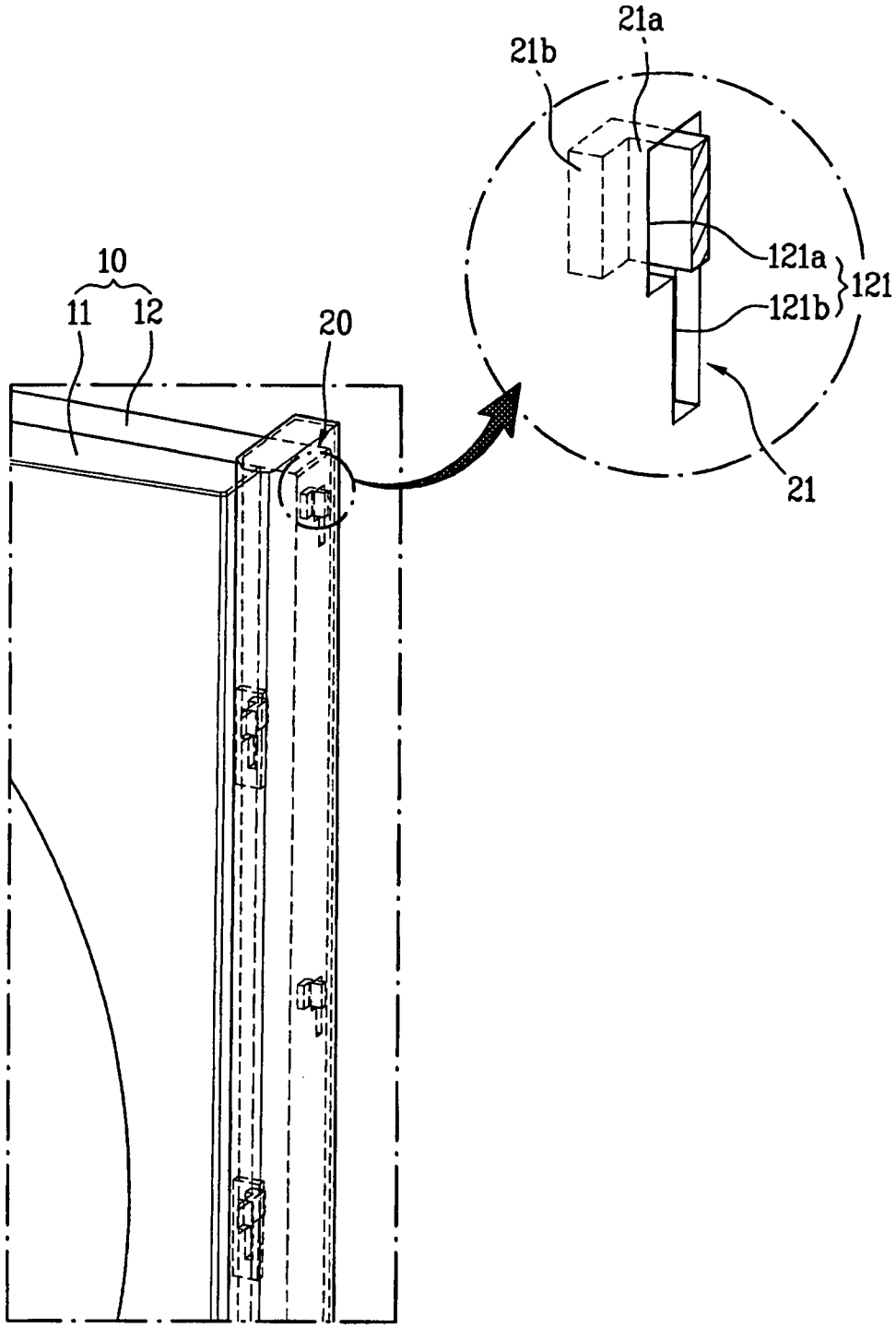

【Figure 6】
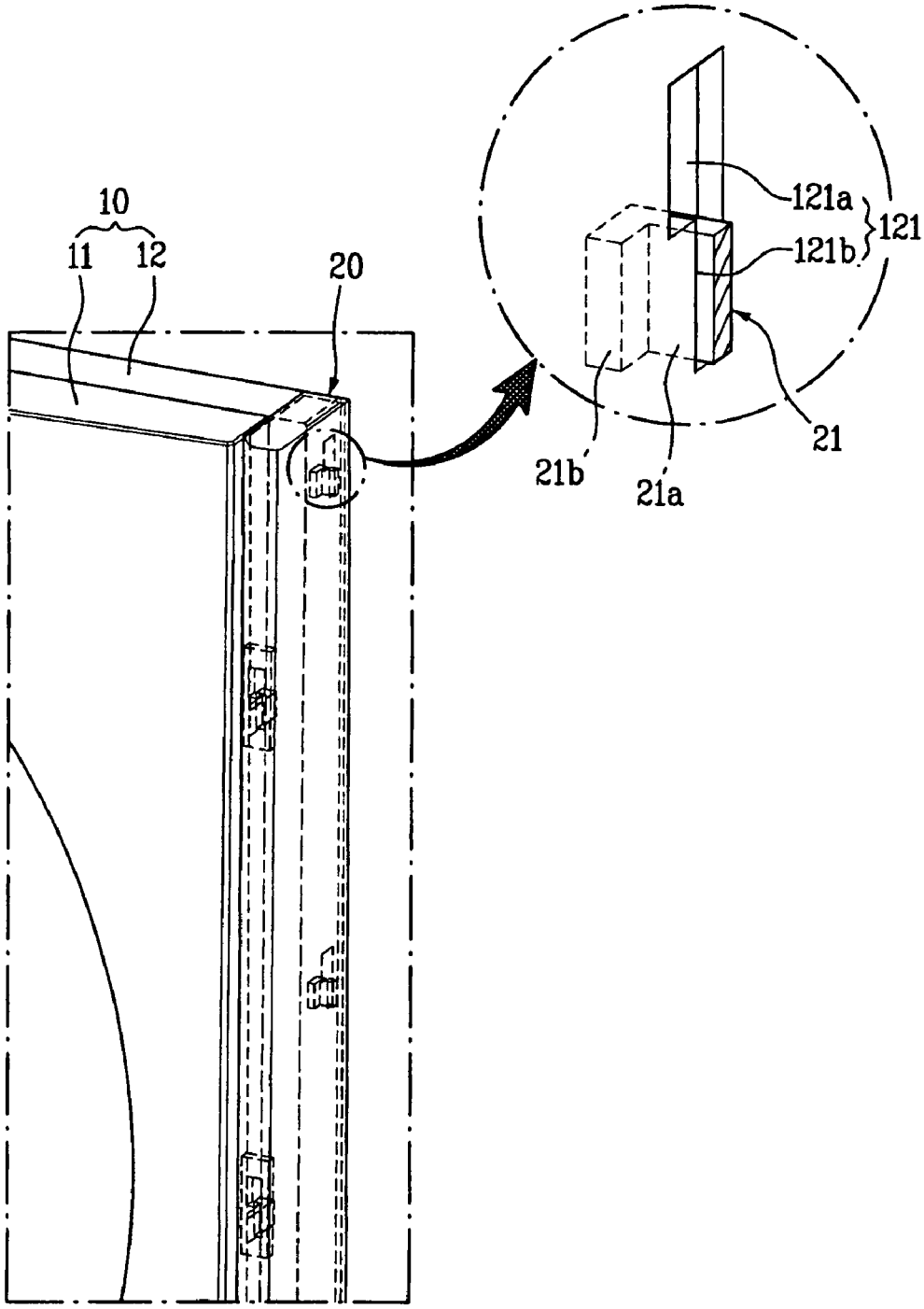

PANEL ASSEMBLY OF A WASHING MACHINE

This application claims the benefit of Korean Patent Application No. 10-2005-0076785 filed on Aug. 22, 2005, which is hereby incorporated by reference as if fully set forth herein.

BACKGROUND OF THE INVENTION

1. Field of the Invention

The present invention relates to a washing machine.

2. Description of the Related Art

Generally, a drum-type washing machine includes a tub mounted in a vertical direction with respect to a main body and a drum installed in the tub to be capable of reversibly rotating. The laundry is loaded in the drum and washed by chemical reaction by the washing machine and detergent and physical reaction generated by lifting and falling of the laundry. Therefore, the drum-type washing machine has been widely used as it less entangles the laundry as compared with the pulsator-type washing machine.

FIG. 1 shows a conventional washing machine.

A drum-type washing machine includes a top plate 1, a cabinet 2 defining an outer wall of the washing machine, a control panel 3 provided with a variety of manipulation buttons, a front panel 4 having a laundry input opening, and upper and lower decoration panels 5 and 6 installed on both sides of the control and front panels 3 and 4.

The top plate 1 and the cabinet 2 define an outer appearance of the drum-type washing machine while protecting a variety of components of the drum-type washing machine. The control panel 3 includes a variety of buttons for inputting a washing mode and other functions and a display unit for displaying a current washing cycle of the drum-type washing machine.

The front panel 4 is formed under the control panel 3 to define the front portion of the drum-type washing machine and a laundry input opening is formed on a central portion of the front panel 4.

The side decoration panel 6 is installed on both sides of the front panel 4 to improve the outer appearance of the washing machine.

A process for coupling the side decoration panels to the front panel will now be described with reference to FIGS. 2 and 3.

As shown in FIGS. 2 and 3, first fixing holes 41 are formed on opposite end portions of the front panel 4 and second fixing holes 42 are formed on a side-rear portion of the front panel 4. At this point, the first and second fixing holes 41 and 42 are arranged along a vertical length.

First and second hooks 61 and 62 corresponding to the first and second fixing holes 41 and 42 are formed on an inner side of the side decoration panel 6.

Describing the coupling process of the side decoration panel 6 to the front panel 4, the first hooks 61 formed on the side decoration panel 6 are first inserted in the first fixing holes 41 to guide the position of the side decoration panel 6. Next, the second hooks 62 are inserted in the second fixing holes 42 of the front panel 4 to fix the side decoration panel 6 to the front panel 4. In this process, the second hook 62 is elastically deformed to be forcedly fitted in the second fixing hole 62.

The above-described coupling process has the following problems.

Referring to FIG. 2, during the process that the second hooks 62 are forcedly fitted in the second fixing holes 42 while being elastically deformed, the second hooks 62 interfere with the outer circumferential end portion A of the second fixing hole 42. Therefore, the portion A may be worn and damaged.

As a result, even when the second hooks 62 are coupled to the second holes 62, the secure assembling cannot be realized between the side decoration panel 6 and the front panel 4 since the coupling force between the second hooks 62 and the second fixing holes 42 are weakened.

In addition, since the second hooks 62 are forcedly fitted in the second fixing holes 42, the assembling work is complicated and inconvenient.

SUMMARY OF THE INVENTION

Accordingly, the present invention is directed to a washing machine that substantially obviates one or more problems due to limitations and disadvantages of the related art.

An object of the present invention is to provide a washing machine in which a side decoration panel can be securely assembled with a front panel without wearing the assembled portion and generating a gap on the assembled portion by improving the coupling structure between the side decoration panel and the front panel.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a washing machine including: a front panel defining a front portion of the washing machine; a decoration panel covering a front-outer circumference of the front panel; a coupling projection formed on at least one of the front and decoration panels; and a slot-shaped hole formed on at least one of the front and decoration panels so that the coupling projection can be sliding-coupled thereto.

According to another aspect of the present invention, there is provided a washing machine including: a front panel defining a front portion of the washing machine; a decoration panel covering a front-outer circumference of the front panel; a coupling projection formed on at least one of the front and decoration panels; and a projection coupling hole on at least one of the front and decoration panels so that the coupling projection can be forcedly fitted thereto.

According to still another aspect of the present invention, there is provided a washing machine including: a front panel defining a front portion of the washing machine; a decoration panel covering a front-outer circumference of the front panel; a coupling projection formed on at least one of the front and decoration panels, the coupling projection having a connecting portion having a predetermined length and a bent portion bent from the connecting portion; and a projection coupling hole formed on at least one of the front and decoration panels, the projection coupling hole having a projection insertion hole in which the coupling projection can be inserted and a projection fixing hole along which the inserted coupling projection can slide.

According to the present invention, since the ⅂-shaped sliding holes are alternately formed on the front panels and the side decoration panel is provided with the fixing portions having bent ribs, the side decoration panel is slidably fixed on the front panel, thereby preventing the coupling portions from being damaged and improving the assembling convenience.

Therefore, the assembling is uniformly realized, the outer appearance of the product can be improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of a conventional drum type washing machine;

FIGS. 2 and 3 are cross-sectional views illustrating a coupling process of a side decoration panel to a front panel and showing problems of the conventional drum type washing machine;

FIG. 4 is an exploded perspective view of a front panel and a side decoration panel according to an embodiment of the present invention;

FIG. 5 is a schematic side view of the side decoration panel and the front panel shown in FIG. 4 before they are coupled to each other; and FIG. 6 is a schematic side view of the side decoration panel and the front panel shown in FIG. 4 after they are coupled to each other.

DETAILED DESCRIPTION OF THE INVENTION

Reference will now be made in detail to the preferred embodiments of the present invention, examples of which are illustrated in the accompanying drawings.

FIG. 4 is an exploded perspective view of a front panel and a side decoration panel according to an embodiment of the present invention.

Referring to FIG. 4, a front panel includes an outer cover 11 and an inner cover 12.

The outer cover 11 is provided at a front-central potion with a laundry input opening 11*a* through which the laundry is loaded and unloaded. In addition, a door (not shown) may be hingedly coupled to a side of the laundry input opening 11*a* to selectively open and close the laundry input opening 11*a*.

A plurality of flanges 112 are formed on both sides of the outer cover 11 and spaced apart from each other in a vertical direction. Each of the flanges 112 is provided with first sliding hole 111 having upper and lower holes 11*a* and 111*b*. The first sliding hole 111 may be formed in a ¬-shape. A size of the upper hole 11*a* is greater than that of the lower hole 111*b*.

Meanwhile, the inner cover 12 may be installed in rear of the outer cover 11 and have an edge bent inward to provide a bent surface 120.

A plurality of second sliding holes 121 are formed on both bent surfaces 120 of the inner cover 12. Like the first sliding holes 111, the second sliding hole 121 is formed in a ¬-shape having upper and lower holes 121*a* and 121*b*. The second sliding holes 121 and the first sliding holes 111 are alternately formed along a vertical length. The first sliding holes 111 are formed on the flanges 112 of the outer cover 11 and oriented frontward and the second sliding holes 121 are formed on the bent surface 120 and oriented sideward. That is, the sidling directions of the sliding holes 111 and 121 are perpendicular to each other.

Meanwhile, the side decoration panel 2 has a height same as that of the front panel 1. First and second fixing portions 21 and 22 corresponding to the first and second sliding holes 111 and 121 are formed on an inner surface of the side decoration panel 2 in the vertical direction.

Here, the first and second fixing portions 21 and 22 have coupling parts 21*a* and 22*a* and ribs 21*b* and 22*b*. The ribs 21*b* and 22*b* are bent from the coupling parts 21*a* and 22*a* at right angles so that the first and second fixing portions 21 and 22 are not removed from the sliding holes 111 and 121 as the ribs 21*b* and 22*b* are hooked on the lower holes 111*b* and 121*b*. The bending directions of the ribs 21*b* and 22*b* of the first and second fixing portions 21 and 22 are different from each other so that the ribs 21*b* and 22*b* can be coupled to the sliding holes 111 and 121 extending from the front panel 1 at right angles.

Meanwhile, the side decoration panel 2 may be formed of ABS that is endurable.

The coupling process of the side decoration panel 2 to the front panel 1 will be now be described with reference to FIGS. 5 and 6.

The front panel 1 includes the outer and inner covers 11 and 12. At this point, the inner cover 12 is mounted on the rear portion of the outer cover 11. Here, the first sliding holes 111 of the outer cover 11 is oriented frontward with reference to the front panel 1 and the second sliding holes 121 of the inner cover 12 are oriented sideward with reference to the front panel 1.

As shown in FIG. 1, the first fixing portions 22 are inserted in the first sliding holes 11 and the second fixing portions 21 are inserted in the second sliding holes 121. That is, as the first fixing portions 22 are inserted in the upper hole 111*a* of the first sliding holes 111, the second fixing portions 21 are simultaneously inserted in the upper holes 121*a* of the second sliding holes 121.

Next, as shown in FIG. 6, the side decoration panel 2 slides downward so that the ribs 21*b* and 22*b* of the first and second fixing portions 22 and 21 can be interlocked with the lower holes 121*b* of the first and second sliding holes 111 and 121, thereby completing the assembling process of the side decoration panel 2 with the front panel 1.

During the above process, since the sliding holes 111 and the sliding holes 121 are alternately formed on the outer and inner covers 11 and 12, respectively, a distance between the adjacent sliding holes 111 and 121 is reduced so that the fixing portions 21 and 22 of the side decoration panel 2 are tightly fixed on the front panel 1.

According to the present invention, since the ¬-shaped sliding holes are alternately formed on the front panels and the side decoration panel is provided with the fixing portions having bent ribs, the side decoration panel is slidably fixed on the front panel, thereby preventing the coupling portions from being damaged and improving the assembling convenience.

Therefore, the outer appearance and reliability of the products can be improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A panel assembly of a washing machine comprising:

a front panel defining a front portion of the washing machine, the front panel comprising an outer cover having a first lateral surface and an opening through which a laundry is loaded or unloaded and an inner cover coupled to a rear of the outer cover and having a front surface and a second lateral surface bent from the front surface, the front surface extended from an end of the first lateral surface sideward;

a plurality of holes formed on the front panel, the holes including a first sliding hole formed on a flange protruded from the first lateral surface and a second sliding hole formed on the second lateral surface;

a decoration panel covering the first lateral surface and the second lateral surface; and a plurality of coupling projections formed on the decoration panel, the coupling projections including a first fixing portion coupled to the first sliding hole and a second fixing portion coupled to the second sliding hole;

wherein at least one of the plurality of coupling projections includes a coupling part extended in one direction to be inserted into the at least one of the plurality of holes and a rib extended in another direction from the coupling part to be hooked around the hole.

2. The panel assembly of a washing machine according to claim 1, wherein at least one of the holes includes a projection insertion hole in which the coupling projection is inserted and a projection fixing hole along which the inserted coupling projection slides.

3. The panel assembly of a washing machine according to claim 1, wherein a width of a sliding starting portion of the holes is greater than a width of the coupling projections.

4. The panel assembly of a washing machine according to claim 1, wherein a width of a sliding end portion of the coupling holes is equal to or less that a width of the coupling projections.

5. The panel assembly of a washing machine according to claim 1, wherein at least one of the coupling projections is forcedly fitted in the holes.

6. The panel assembly of a washing machine according to claim 1, wherein the coupling part is substantially perpendicular to the rib.

7. The panel assembly of a washing machine according to claim 1, wherein the holes and the coupling projections are paired and a plurality of pairs of the holes and the coupling projections are provided.

8. The panel assembly of a washing machine according to claim 1, wherein the pairs of the holes and the coupling projections, which are oriented in a first direction, and the pairs of the holes and the coupling projections, which are oriented in a second direction, are alternately disposed with each other.

9. A panel assembly of a washing machine comprising:

a front panel defining a front portion of the washing machine, the front panel comprising an outer cover having a first lateral surface and an opening through which a laundry is loaded or unloaded and an inner cover coupled to a rear of the outer cover and having a front surface and a second lateral surface bent from the front surface, the front surface extended from end of the first lateral surface sideward;

a flange configured to protrude from the first lateral surface in a direction of the outside of the outer cover;

a decoration panel covering an outer circumference of the outer cover and the inner cover;

a plurality of coupling projections formed on the decoration panel; and a plurality of projection coupling holes on the front panel so that the coupling projections are forcedly fitted thereto, the projection coupling holes including a first sliding hole passed through the flange frontward and a second sliding hole passed through the second lateral surface sideward, wherein at least one of the coupling projections includes a coupling part extended in one direction to be inserted into the hole and a rib extended in another direction from the coupling part to be hooked around the hole.

10. The panel assembly of a washing machine according to claim 9, wherein a width of a sliding starting portion of the projection coupling holes is greater than a width of the coupling projections.

11. The panel assembly of a washing machine according to claim 9, wherein a width of a sliding end portion of the coupling holes is equal to or less that a width of the coupling projections.

12. The panel assembly of a washing machine according to claim 9, wherein the coupling part is substantially perpendicular to the rib.

13. The panel assembly of a washing machine according to claim 9, wherein the projection coupling holes include a projection insertion hole in which the coupling projection is inserted and a projection fixing hole along which the inserted coupling projection slides and is forcedly fitted.

14. The panel assembly of a washing machine according to claim 9, wherein the projection coupling holes and the coupling projections are paired and a plurality of pairs of the projection coupling hole and the coupling projection are provided.

15. The panel assembly of a washing machine according to claim 14, wherein the pairs of the projection coupling holes and the coupling projections are oriented in at least two directions.

16. The panel assembly of a washing machine according to claim 15, wherein the pairs of the projection coupling holes and the coupling projections, which are oriented in a first direction, and the pairs of the projection coupling holes and the coupling projections, which are oriented in a second direction, are alternately disposed with each other.

* * * * *